US009315933B1

(12) United States Patent
Martelli et al.

(10) Patent No.: US 9,315,933 B1
(45) Date of Patent: Apr. 19, 2016

(54) STITCH REGULATION APPARATUS AND METHOD

(71) Applicants: John D. Martelli, Pensacola, FL (US); Marsha Martelli, Pensacola, FL (US)

(72) Inventors: John D. Martelli, Pensacola, FL (US); Marsha Martelli, Pensacola, FL (US)

( * ) Notice: Subject to any disclaimer, the term of this patent is extended or adjusted under 35 U.S.C. 154(b) by 544 days.

(21) Appl. No.: 13/815,866

(22) Filed: Mar. 15, 2013

(51) Int. Cl.
*D05B 19/14* (2006.01)
*D05B 11/00* (2006.01)
*D05B 21/00* (2006.01)

(52) U.S. Cl.
CPC ..... *D05B 19/14* (2013.01); *D05B 11/00* (2013.01); *D05B 21/00* (2013.01)

(58) Field of Classification Search
CPC ..... D05B 73/12; D05B 59/02; D05B 39/00; D05B 21/00; D05B 51/00; D05B 27/22; D05B 19/08; D05B 35/102; G05B 2219/2626
USPC ..... 112/475.01, 475.02, 475.04, 475.05, 112/273, 278, 314, 315, 102.5, 470.03, 112/470.06; 700/136, 137
See application file for complete search history.

(56) References Cited

U.S. PATENT DOCUMENTS

| | | | | |
|---|---|---|---|---|
| 6,871,606 | B2 * | 3/2005 | Schweizer | D05B 19/16 112/102.5 |
| 6,959,657 | B1 * | 11/2005 | Duval | D05B 19/14 112/272 |
| 7,210,417 | B2 * | 5/2007 | Koerner | D05B 19/14 112/278 |
| 7,373,891 | B2 * | 5/2008 | Koerner | D05B 11/00 112/103 |
| 8,297,211 | B2 * | 10/2012 | Stokes | D05B 11/00 112/102.5 |
| 9,115,451 | B2 * | 8/2015 | Konzak | D05B 19/12 |

* cited by examiner

*Primary Examiner* — Tejash Patel
(74) *Attorney, Agent, or Firm* — J. Nevin Shaffer, Jr.

(57) ABSTRACT

A stitch regulation apparatus and method includes a material manipulation device. A movement detection device is connected with the material manipulation device and the movement detection device transmits the speed of movement of the material manipulation device. A receiver device receives transmissions from the movement detection device and a programmable speed regulation device containing stitch parameters, that is connected with a sewing machine and the receiver device, such that the speed regulation device receives movement data from the receiver device and regulates the speed of a sewing machine relative to movement data so as to produce the programmed stitch parameters in material to be stitched.

20 Claims, 2 Drawing Sheets

STITCH REGULATION APPARATUS AND METHOD

FIELD OF THE INVENTION

This invention relates to a stitch regulation apparatus and method. In particular, in accordance with one embodiment, the invention relates, to a stitch regulation apparatus including a material manipulation device. A movement detection device is connected with the material manipulation device and the movement detection device transmits the speed of movement of the material manipulation device. A receiver device receives transmissions from the movement detection device and a programmable speed regulation device containing stitch parameters, that is connected with a sewing machine and the receiver device, such that the speed regulation device receives movement data from the receiver device and regulates the speed of a sewing machine relative to movement data so as to produce the programmed stitch parameters in material to be stitched.

BACKGROUND OF THE INVENTION

A problem exists with regard to the use of sewing machines. The problem with prior art sewing machines and systems is that the speed with which a piece of material is manipulated or moved dictates the spacing of the resulting stitching. That is, a piece of material that is moved quickly beneath the needle of the sewing machine results is widely spaced stitches. Conversely, slow movement of material results in closely spaced stitches. When the stitching is obvious and important to the overall look of the finished material, the spacing of stitches is a constant worry and headache.

Additionally, straight line stitching is the easiest to control so far as speed of movement and spacing of stitching is concerned. However, most stitching includes non-straight line movement, curves and turns as when spelling words or making designs in material with the stitching. It is nearly impossible, with the prior art sewing systems, except by the most skilled and patient users, to evenly space stitches that are non-linear. Further, the resulting loss in time and materials in correcting inappropriately spaced stitches discourages those who otherwise might enjoy and profit from such activities.

Thus, there is a need in the art for a stitch regulation device that enables users of all skill levels to create stitches that exactly match their needs and desires. It therefore is an object of this invention to provide a stitch regulation apparatus and method that regulates stitches made by a sewing machine, that is easy to use and simple to set and reset and that ensures that whatever stitching spacing is desired will be maintained no matter what speed or direction the material is moved while being stitched.

SUMMARY OF THE INVENTION

Accordingly, the stitch regulation apparatus of the present invention, according to one embodiment, includes a material manipulation device. A movement detection device is connected with the material manipulation device where the movement detection device transmits the speed of movement of the material manipulation device. A receiver device for receiving transmissions from the movement detection device is provided. A programmable speed regulation device containing stitch parameters is connected with a sewing machine and the receiver device such that the speed regulation device receives movement data from the receiver device and regulates the speed of the sewing machine relative to the movement data to produce the programmed stitch parameters in material to be stitched.

As used herein, terms are given their common meaning as known to those of ordinary skill in the art. "Material" includes material such as quilting material, cloth material and any material capable of being stitched with a sewing machine as is now known or hereafter developed. Thus, "material manipulation device" is a device that connects with material, typically temporarily, so as to controllably move the material as it is stitched. Such a device is illustrated in the Figures herein and known in the art. Further, "movement detection device" is an electrical mechanical device for detecting movement, "receiver device" is an electrical device for receiving electronic signals generated by the movement detection device and "programmable speed regulation device" is any device, such as a computer, for containing program instructions and controlling the attached sewing machine motor in accordance with those program instructions and the movement data received. Again, these devices are all well within the ordinary skill level of those in the art.

In one aspect of this invention, the programmable speed regulation device is programmed to operate the sewing machine so as to create a desired number of stitches per inch. In another aspect, the programmable speed regulation device is programmed to operate the sewing machine so as to create a desired number of stitches per inch no matter what speed the material manipulation device is moved. In a further aspect, the programmable speed regulation device is programmed to operate the sewing machine so as to create a desired number of stitches per inch no matter what speed or direction the material manipulation device is moved.

In another aspect of the invention, the material manipulation device includes an open center within which material is captured and stitched. In one aspect, the material manipulation device is a circularly shaped device with an open center within which material is captured and stitched. In a further aspect, the material manipulation device is a square shaped device with an open center within which material is captured and stitched.

In one aspect, the movement detection device is connected with an extended arm attached with the material manipulation device. In one aspect, the material is quilting.

According to another embodiment of the invention, a stitch regulation apparatus includes a material manipulation device where the material manipulation device includes an open center within which material is captured and stitched. A movement detection device is connected with the material manipulation device and the movement detection device transmits the speed of movement of the material manipulation device. A receiver device is provided for receiving transmissions from the movement detection device. A programmable speed regulation device containing stitch parameters is connected with a sewing machine and with the receiver device such that the speed regulation device receives movement data from the receiver device and regulates the speed of a sewing machine relative to the movement data so as to produce programmed stitch parameters in material to be stitched and where the programmable speed regulation device is programmed to operate the sewing machine so as to create a desired number of stitches per inch.

In one aspect, the programmable speed regulation device is programmed to operate the sewing machine so as to create a desired number of stitches per inch no matter what speed the material manipulation device is moved. In another aspect, the programmable speed regulation device is programmed to operate the sewing machine so as to create a desired number of stitches per inch no matter what speed or direction the material manipulation device is moved.

In one aspect, the material manipulation device is a circularly shaped device with an open center within which material is captured and stitched. In another aspect, the material manipulation device is a square shaped device with an open center within which material is captured and stitched.

In a further aspect, the movement detection device is connected with an extended arm attached with the material manipulation device. In one aspect, the material is quilting.

According to another embodiment of the invention, a method for stitch regulation includes the following steps:

a. providing a material manipulation device; with a movement detection device connected with the material manipulation device where the movement detection device transmits the speed of movement of the material manipulation device; a receiver device for receiving transmissions from the movement detection device; and a programmable speed regulation device for containing stitch parameters connected with a sewing machine and the receiver device where the speed regulation device receives movement data from the receiver device and regulates the speed of a sewing machine relative to the movement data to produce the programmed stitch parameters in material to be stitched; and b. programming the programmable speed regulation device with parameters to produce a desired number of stitches per inch.

In one aspect, the programmable speed regulation device is programmed to operate said sewing machine so as to create a desired number of stitches per inch no matter what speed the material manipulation device is moved.

In another aspect, the programmable speed regulation device is programmed to operate the sewing machine so as to create a desired number of stitches per inch no matter what speed or direction the material manipulation device is moved.

In a further aspect, the material manipulation device includes an open center within which material is captured and stitched.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
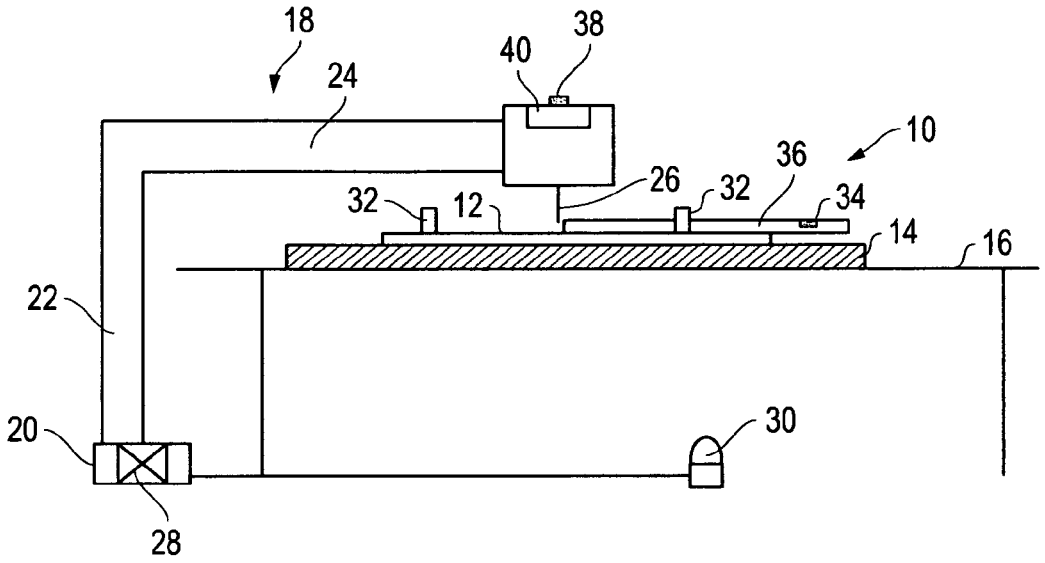
FIG. 1 is a side view of the stitch regulation apparatus according to one embodiment.
Figure 2:
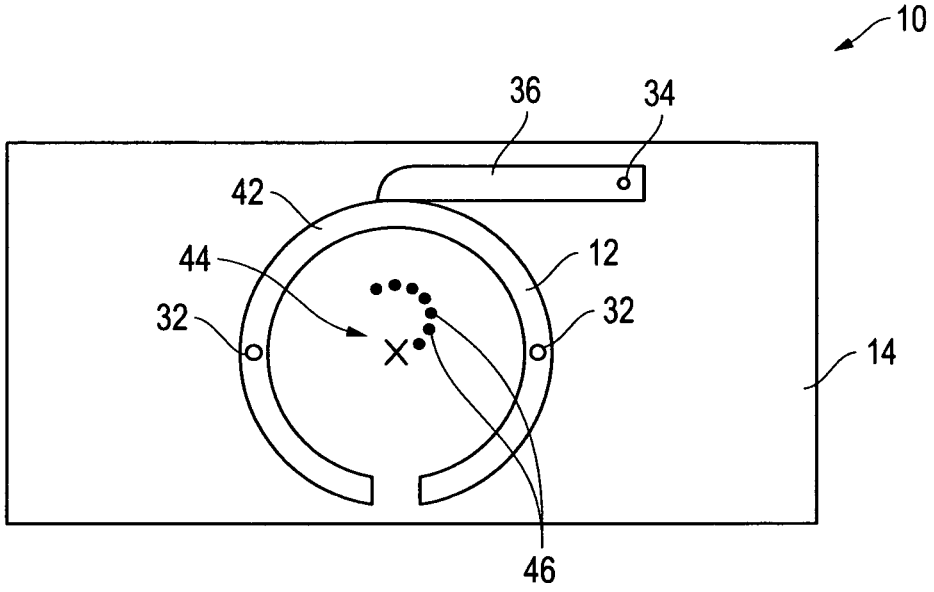
FIG. 2 is a top view showing a circularly shaped material movement device.
Figure 3:
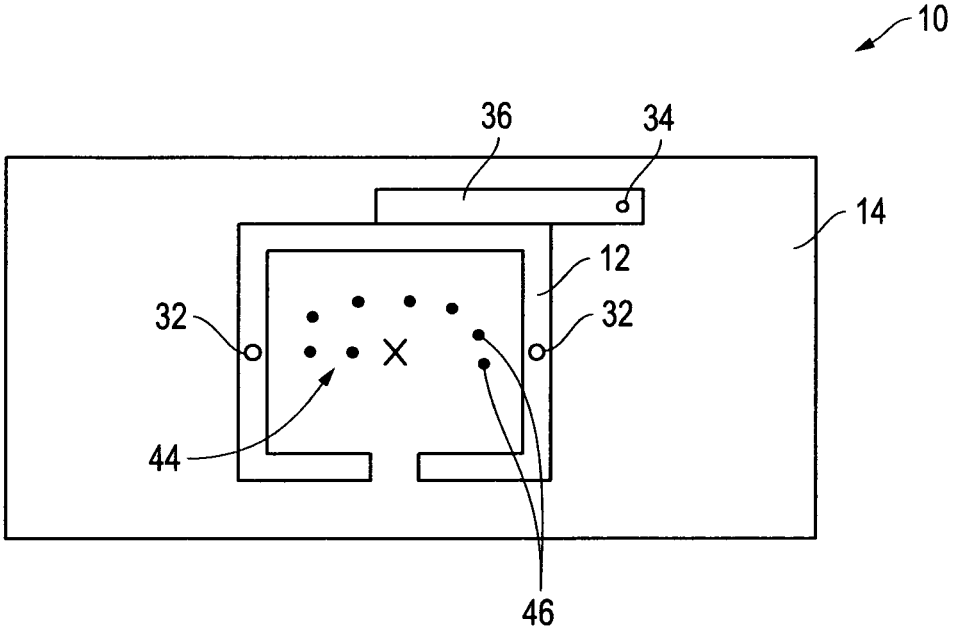
FIG. 3 is a top view showing a square shaped material movement device.

The preferred embodiment of the present invention is illustrated by way of example in FIGS. 1-3. With specific reference to FIG. 1, stitch regulation apparatus 10 includes material movement device 12. Material 14 is shown lying on top of sewing surface 16. Sewing machine 18 is shown next to sewing surface 16. Sewing machine 18 includes, among other things, a base 20, support 22, arm 24, needle 26, motor 28 and foot peddle 30, all as are known in the art.

Preferably, material movement device 12 includes handles 32. Placing material movement device on top of material 14 enables a user to guide material 14 as desired in a controlled and secure manner as will be described more fully hereafter with regard to FIGS. 2 and 3.

Movement detection device 34 is connected with material movement device 12. Movement detection device 34 is any electro-mechanical device that detects movement, both speed and direction. Applicants have determined that a preferred connection is by means of extended arm 36 such that movement detection device is removed from location near to the needle 26. In any case, movement of material movement device 12 results in identical movement of movement detection device 34.

Movement detection device 34 is conformed to transmit movement data to receiver device 38. Receiver device 38 receives the data transmissions from movement detection device 34 and sends the data to programmable speed regulation device 40. FIG. 1 shows receiver device 38 as a separate device and connected or attached to arm 24 of sewing machine 18. Applicants have determined that receiver device 38 could be located elsewhere and still function adequately and that it could be combined with programmable speed regulation device 40.

Importantly, speed regulation device 40 is connected with motor 28 of sewing machine 18 and controls the speed of needle 26 in accordance with two inputs: the speed of material movement device 12 and the requirements of programmed stitch parameters. As used herein, the term "programmed stitch parameters" refers to computer instructions in proper computer language for regulating stitch spacing. Such computer instructions are well within ordinary skill levels of those in the art and will not be disclosed more fully herein. Suffice to say, a simple computer of minimal capabilities is sufficient to the required task.

Stitch parameters are developed to accommodate the user's stitch requirements. That is, stitch parameters include, for example only and not by way of limitation, the spacing between stitches that is to be maintained no matter the speed or direction of movement of material movement device 12.

Referring now to FIGS. 2 and 3, other features of the stitch regulation apparatus 10 are illustrated. FIG. 2, illustrates a preferred embodiment of material movement device 12 in a circular form 42. Circular form 42 creates an open space 44 within which stitches 46 are made by needle 26 (not shown in these figures but its position is indicated by an "X").

FIG. 3 illustrates a preferred embodiment of material movement device 12 in a square form 46. Like circular form 42, square form 46 creates an open space 44 within which stitches 46 are made by needle 26 (not shown in these figures but its position is indicated by an "X").

Still referring to FIGS. 2 and 3, the result of applying different stitch parameters is illustrated by small spaces between stitches 46 in FIG. 2 and large spaces between stitches 46 in FIG. 3. Importantly, the stitch spaces are consistent no matter the speed or direction of movement of the material 14 by material movement device 12. The Figures show a curved shape in each case but, again, in accordance with the invention, the spacing of the stitches 46 is regulated and created in accordance with the stitch parameters established in programmable speed regulation device 40 as discussed above. Certainly, even spaces may not be desired and the spaces may be contracted or expanded as desired and for effect.

In operation, a user sets the desired parameters in programmable regulation device 40. This may be as simple as selecting a stitch spacing option from a menu of options. Once selected, the movement of material movement device 12 is transmitted, received, and applied as described above. In accordance with the invention, no matter how fast or what direction the user moves the material 14 with material movement device 12, motor 28 is controlled by programmable regulation device 40 to operate at a speed that results in the creation of stitches 46 with the desired spacing.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A stitch regulation apparatus comprising:

a. a material manipulation device wherein said material manipulation device includes an open center within which material is captured and stitched;

b. a movement detection device connected with said material manipulation device wherein said movement detection device transmits the speed of movement of the material manipulation device;

c. a receiver device for receiving transmissions from said movement detection device; and d. a programmable speed regulation device containing stitch parameters connected with a sewing machine and said receiver device wherein said speed regulation device receives movement data from said receiver device and regulates the speed of a sewing machine relative to said movement data to produce the programmed stitch parameters in material to be stitched.

2. The apparatus of claim 1 wherein said programmable speed regulation device is programmed to operate said sewing machine so as to create a desired number of stitches per inch.

3. The apparatus of claim 1 wherein said programmable speed regulation device is programmed to operate said sewing machine so as to create a desired number of stitches per inch no matter what speed the material manipulation device is moved.

4. The apparatus of claim 1 wherein said programmable speed regulation device is programmed to operate said sewing machine so as to create a desired number of stitches per inch no matter what speed or direction said material manipulation device is moved.

5. The apparatus of claim 1 wherein said material manipulation device is a circularly shaped device with an open center within which material is captured and stitched.

6. The apparatus of claim 1 wherein said material manipulation device is a square shaped device with an open center within which material is captured and stitched.

7. The apparatus of claim 1 wherein said movement detection device is connected with an extended arm attached with said material manipulation device.

8. The apparatus of claim 1 wherein said material is quilting.

9. A stitch regulation apparatus comprising:

a. a material manipulation device wherein said material manipulation device includes an open center within which material is captured and stitched;

b. a movement detection device connected with said material manipulation device wherein said movement detection device transmits the speed of movement of the material manipulation device;

c. a receiver device for receiving transmissions from said movement detection device; and d. a programmable speed regulation device connected with a sewing machine and said receiver device wherein said speed regulation device receives movement data from said receiver device and regulates the speed of a sewing machine relative to said movement data to produce programmed stitch parameters in material to be stitched and wherein said programmable speed regulation device is programmed to operate said sewing machine so as to create a desired number of stitches per inch.

10. The apparatus of claim 9 wherein said programmable speed regulation device is programmed to operate said sewing machine so as to create a desired number of stitches per inch no matter what speed the material manipulation device is moved.

11. The apparatus of claim 9 wherein said programmable speed regulation device is programmed to operate said sewing machine so as to create a desired number of stitches per inch no matter what speed or direction said material manipulation device is moved.

12. The apparatus of claim 9 wherein said material manipulation device is a circularly shaped device with an open center within which material is captured and stitched.

13. The apparatus of claim 9 wherein said material manipulation device is a square shaped device with an open center within which material is captured and stitched.

14. The apparatus of claim 9 wherein said movement detection device is connected with an extended arm attached with said material manipulation device.

15. The apparatus of claim 9 wherein said material is quilting.

16. A method for stitch regulation comprising:

a. providing a material manipulation device wherein said material manipulation device includes an open center within which material is captured and stitched; a movement detection device connected with said material manipulation device wherein said movement detection device transmits the speed of movement of the material manipulation device; a receiver device for receiving transmissions from said movement detection device; and a programmable speed regulation device connected with a sewing machine and said receiver device wherein said speed regulation device receives movement data from said receiver device and regulates the speed of a sewing machine relative to said movement data to produce programmed stitch parameters in material to be stitched; and b. programming said programmable speed regulation device to produce a desired number of stitches per inch.

17. The method of claim 16 wherein said programmable speed regulation device is programmed to operate said sewing machine so as to create a desired number of stitches per inch no matter what speed the material manipulation device is moved.

18. The method of claim 16 wherein said programmable speed regulation device is programmed to operate said sewing machine so as to create a desired number of stitches per inch no matter what speed or direction said material manipulation device is moved.

19. A stitch regulation apparatus comprising:

a. a material manipulation device wherein said material manipulation device is a circularly shaped device with an open center within which material is captured and stitched;

b. a movement detection device connected with said material manipulation device wherein said movement detection device transmits the speed of movement of the material manipulation device;

c. a receiver device for receiving transmissions from said movement detection device; and d. a programmable speed regulation device containing stitch parameters connected with a sewing machine and said receiver device wherein said speed regulation device receives movement data from said receiver device and regulates the speed of a sewing machine relative to said movement data to produce the programmed stitch parameters in material to be stitched.

20. A stitch regulation apparatus comprising:

a. a material manipulation device wherein said material manipulation device is a square shaped device with an open center within which material is captured and stitched;

b. a movement detection device connected with said material manipulation device wherein said movement detection device transmits the speed of movement of the material manipulation device;

c. a receiver device for receiving transmissions from said movement detection device; and d. a programmable speed regulation device containing stitch parameters connected with a sewing machine and said receiver device wherein said speed regulation device receives movement data from said receiver device and regulates the speed of a sewing machine relative to said movement data to produce the programmed stitch parameters in material to be stitched.

* * * * *